US005821830A

United States Patent [19]

Hasegawa

[11] Patent Number: 5,821,830

[45] Date of Patent: Oct. 13, 1998

[54] NON-RECIPROCAL CIRCUIT ELEMENT

[75] Inventor: Takashi Hasegawa, Nagaokakyo, Japan

[73] Assignee: Murata Manufacturing Co., Ltd., Japan

[21] Appl. No.: 766,019

[22] Filed: Dec. 13, 1996

[30] Foreign Application Priority Data

| | | | |
|---|---|---|---|
| Dec. 13, 1995 | [JP] | Japan | 7-324834 |
| Dec. 18, 1995 | [JP] | Japan | 7-329080 |
| Dec. 9, 1996 | [JP] | Japan | 8-328418 |

[51] Int. Cl.[6] ..... H01P 1/383

[52] U.S. Cl. ..... 333/1.1; 333/24.2

[58] Field of Search ..... 333/1.1, 24.2

[56] References Cited

U.S. PATENT DOCUMENTS

| | | | |
|---|---|---|---|
| 2,944,229 | 7/1960 | DeVries | 333/24.2 |
| 3,621,477 | 11/1971 | Bosma | 333/1.1 |
| 4,016,510 | 4/1977 | Hodges, III et al. | 333/24.2 |

FOREIGN PATENT DOCUMENTS

| | | |
|---|---|---|
| 0618636 | 10/1994 | European Pat. Off. . |
| 0682380 | 11/1995 | European Pat. Off. . |
| 52-134349 | 11/1977 | Japan . |

OTHER PUBLICATIONS

European Patent Search dated Mar. 24, 1997.

*Primary Examiner*—Paul Gensler

*Attorney, Agent, or Firm*—Ostrolenk, Faber, Gerb & Soffen, LLP

[57] ABSTRACT

A non-reciprocal circuit element which meets the demand for a reduced size and a lower price. A circulator, which is a type of non-reciprocal circuit element, is constituted by a first central electrode and a second central electrode which are disposed on a main surface of a ferrite member so that they intersect with each other while being electrically insulated from each other; a first input/output port and a second input/output port which are connected to corresponding first ends of the aforesaid two central electrodes and a third input/output port which is connected in common to second ends of the two central electrodes; two matching capacitors connected between the first and second I/O ports, respectively, and the third I/O port; and a magnetic circuit for applying a DC magnetic field to the aforesaid ferrite member.

14 Claims, 16 Drawing Sheets

Return-loss characteristic

Return-loss characteristic

NON-RECIPROCAL CIRCUIT ELEMENT

BACKGROUND OF THE INVENTION

1. Field of the Invention

The present invention relates to an isolator, a circulator, or other non-reciprocal circuit element for use as a high-frequency component for a microwave band.

2. Description of Related Art

A lumped-constant type isolator or circulator, for example, is characterized in that the attenuation thereof is extremely small in the direction in which signals are transmitted, while it is extremely large in the opposite direction; it is used for a transmitting and receiving circuit or the like of a mobile telephone, a cellular telephone, etc. FIG. 14 shows an equivalent circuit diagram of a typical circulator. A circulator 53 has three central electrodes 50, which are electrically insulated and disposed so that they intersect with each other at a predetermined angle. Matching capacitors C are connected to respective input/output ports (hereinafter referred to as "I/O" ports) P1 through P3 at one end of each of the respective central electrodes 50, while the other ends thereof are grounded. A ferrite member 51 is placed in contact with the intersecting section of the aforesaid central electrodes 50 and a magnet (not shown) is arranged to apply a DC magnetic field.

To make an isolator, a terminating resistor is connected to one of the I/O ports.

The ferrite member 51 employed for the foregoing circulator 53 is required to be rotationally symmetrical with respect to the direction in which the DC magnetic field is applied. This is because the use of a ferrite member which is not rotationally symmetrical would disturb the balance among the I/O ports P1 through P3 with resultant deterioration in characteristics. In order to improve the electrical characteristics, the manufacture of the ferrite member, and the assembly of the circulator, a discoid ferrite member has been used.

There has been a demand for smaller and cheaper components of the circulators or isolators employed for recent mobile telephones and the like because of the nature of the applications. To respond to such a demand, there have been proposed structures illustrated in FIG. 15 and FIG. 16 which are exploded perspective views observed from the bottom. A lumped-constant type circulator 55 has an upper yoke 56, which constitutes a magnetic circuit, and a lower yoke 57 which includes a multilayer-dielectric substrate 58, a ferrite disc 59, and a magnet 60. The dielectric substrate 58 is composed of a plurality of dielectric sheets 61 through 66 which are laminated and formed into one piece; each of the dielectric sheets 61 through 66 has patterned grounding electrodes 68, 69, capacitor electrodes 70*a* through 70*c*, and central electrodes 71*a* through 71*c*. Disposed on the topmost layer, namely, the dielectric sheet 61, are zonal terminal sheets 73, on which the I/O port terminal electrodes P1 through P3 and grounding terminal electrodes 72*a* through 72*c* are formed.

To constitute the isolator, an additional layer 77 which has a grounding electrode 75 and a resistance film 76 formed in a pattern is added to the bottommost layer, namely, a dielectric sheet 67 shown in the drawing. The circulator 55 is mounted on a circuit board with the terminal electrodes P1 through P3 facing down.

There has also been proposed a structure in which the aforesaid central electrodes and the matching capacitors are formed into a single unit or one in which the central electrodes and the ferrite disc are formed into a single unit so as to accomplish higher density and fewer components (see Japanese Patent Application No. 4-125630 and Japanese Patent Application No. 4-208963).

Further, the following two-terminal isolator has been disclosed in the laid-open Japanese Unexamined Patent Publication No. 52-134349. As illustrated in FIG. 17, a two-terminal isolator 80 is constituted by: a central electrode assembly, wherein a first central electrode 81 and a second central electrode 82 are disposed on a ferrite member 83 such that they intersect with each other in an electrically isolated state, a first I/O port 84 and a second I/O port 85 are respectively connected to first and second ends of the first central electrode 81 and the second central electrode 82, the first and second ends, respectively, on one side of the first and second central electrodes 81 and 82 are connected through a resistor 86, the second and first ends, respectively, on the other side of the first and second central electrode 81 and 82 are connected to ground 87, and matching capacitors 88 and 89 are connected in parallel to the first central electrode 81 and the second central electrode 82, respectively; and a magnetic circuit (not shown) for applying a DC magnetic field to the foregoing ferrite member. It has been described in the Japanese Unexamined Patent Publication that such a configuration allows the isolation characteristic to be exhibited over a broader frequency range.

In non-reciprocal circuit elements having the structures shown in FIG. 15 and FIG. 16, there is structural limitations make it difficult to achieve higher density and a reduced number of components, posing a problem in that further reduction in size and price of the non-reciprocal circuit element cannot be realized. For instance, the foregoing circulator involves forming the dielectric sheets for all central electrodes, securing the areas on the sheets for accommodating the matching capacitors and the terminal electrodes, or forming through-hole electrodes for interconnecting the respective electrodes. This presents a problem in that the component elements inevitably become larger and their cost becomes higher.

Furthermore, in the two-terminal isolator 80 shown in FIG. 17, if a difference in potential takes place between the first I/O port 84 and the second I/O port 85, then a signal received through the first I/O port is partially attenuated through the resistor connecting the first and second central electrodes 81 and 82, presenting a problem in that the insertion loss characteristic of the two-terminal isolator 80 is deteriorated. Ideally, the potential among the respective I/O ports should be the same in a non-reciprocal circuit element; in an actual use, however, a potential difference occurs among the respective I/O ports due to various factors including the distribution of a magnetic field and the positional relationship between the respective central electrodes and the ferrite member, thus making it difficult to achieve the same potential among the respective I/O ports. Hence, it has not been possible for the two-terminal isolator 80 shown in FIG. 17 to solve the problem of the deterioration in the insertion loss characteristic.

In addition, although the two-terminal isolator 80 shown in FIG. 17 permits the isolation characteristic to be improved over a broader band width, it exhibits an improved return loss characteristic at the same I/O port over only a narrow band. FIG. 18 is a chart illustrative of the measurements of the return loss characteristic at the I/O port P1 of the two-terminal isolator 80 shown in FIG. 17.

For example, when the attenuation is 15 dB, a three-terminal isolator shown in FIG. 15 and FIG. 16 provides a 200 MHZ band width, whereas the two-terminal isolator shown in FIG. 17 provides only about 80 MHz as seen from FIG. 18. Thus, the return loss characteristic in the limited band width has been making it difficult for the two-terminal isolator shown in FIG. 17 to achieve matching with electronic circuits or electronic components connected to the input end of the isolator.

SUMMARY OF THE INVENTION

Accordingly, the present invention has been made with a view toward solving the problems described above, and it is an object of the present invention to provide a non-reciprocal circuit element which permits a higher density of components and a reduced number of components, thus meeting the demand for a smaller and cheaper non-reciprocal circuit element.

To this end, according to the present invention, there is provided a non-reciprocal circuit element comprising: a central electrode assembly composed of first and second central electrodes which are disposed on a ferrite member in such a manner that they intersect with each other in an electrically insulated state and which has first and second I/O ports respectively connected to the ends on one side of the first and second central electrodes, and a third I/O port connected to the ends on the other side thereof; and a magnetic circuit for applying a DC magnetic field to the ferrite member.

In a preferred form, a matching circuit is configured by connecting a capacitor between the first and second I/O ports and the third I/O port.

In another preferred form, a terminating resistor is connected to any one of the I/O ports.

In a further preferred form, either the first or the second I/O port is grounded, and a resistance which is approximately equal to a terminal impedance of the ports is connected in parallel between the remaining I/O port and the third I/O port.

In yet another preferred form, the foregoing central electrode assembly is composed of insulating sheets and the above-mentioned central electrodes which are stacked alternately with the insulating sheets interleaved between the central electrodes, thereby constituting a laminated body.

In a further preferred form, the respective I/O port electrodes to which the respective central electrodes are connected are formed on the outer surface of the laminated body.

In a still further preferred form, the foregoing insulating sheets are composed of ferrite.

Other features and advantages of the present invention will become apparent from the following description of embodiments of the invention which refers to the accompanying drawings.

DESCRIPTION OF EMBODIMENTS OF THE INVENTION

Embodiments in accordance with the present invention will now be described in conjunction with the accompanying drawings.

Figure 1:
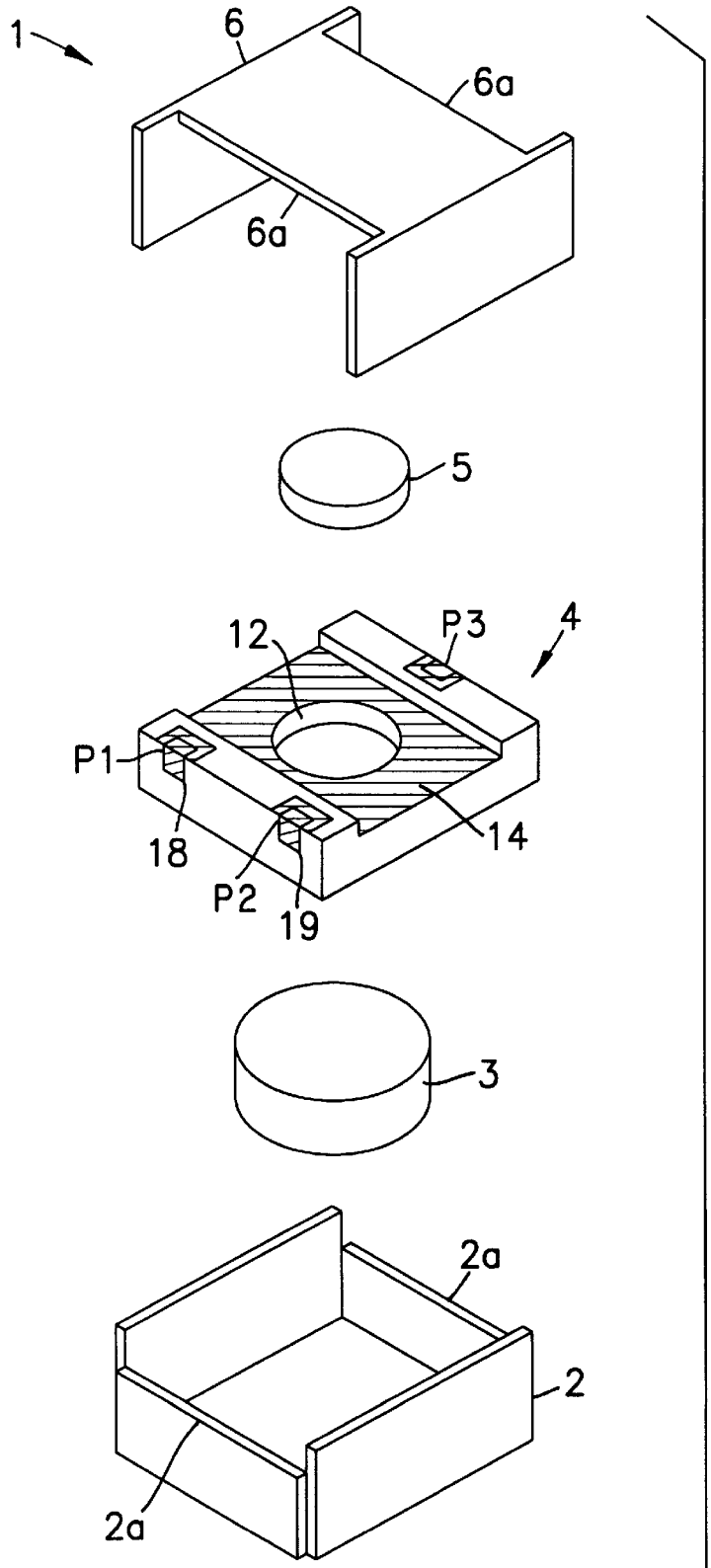
FIG. 1 is an exploded perspective view illustrating a circulator according to a first embodiment of the present invention.
Figure 2:
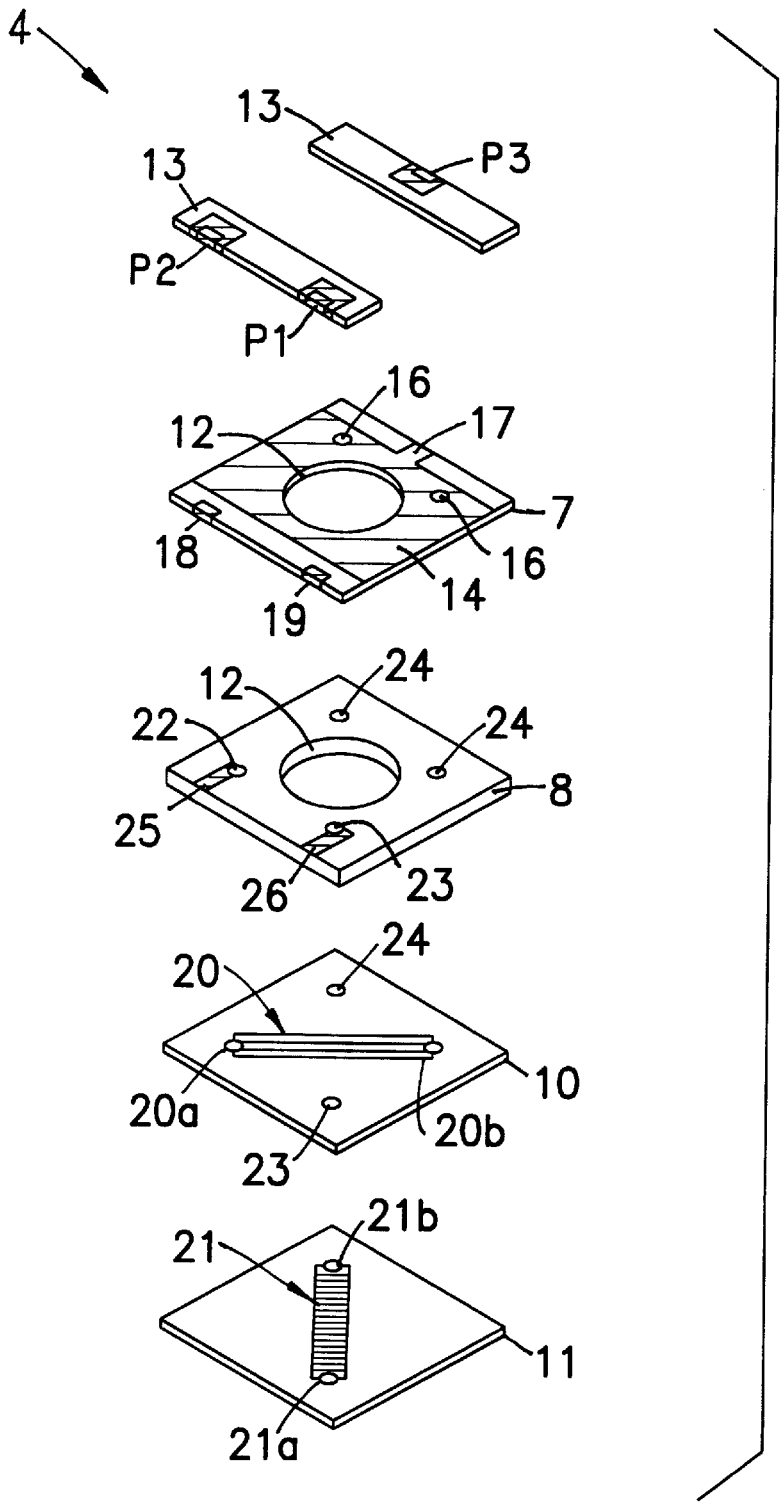
FIG. 2 is an exploded perspective view of a dielectric substrate of the circulator of FIG. 1.
Figure 3:
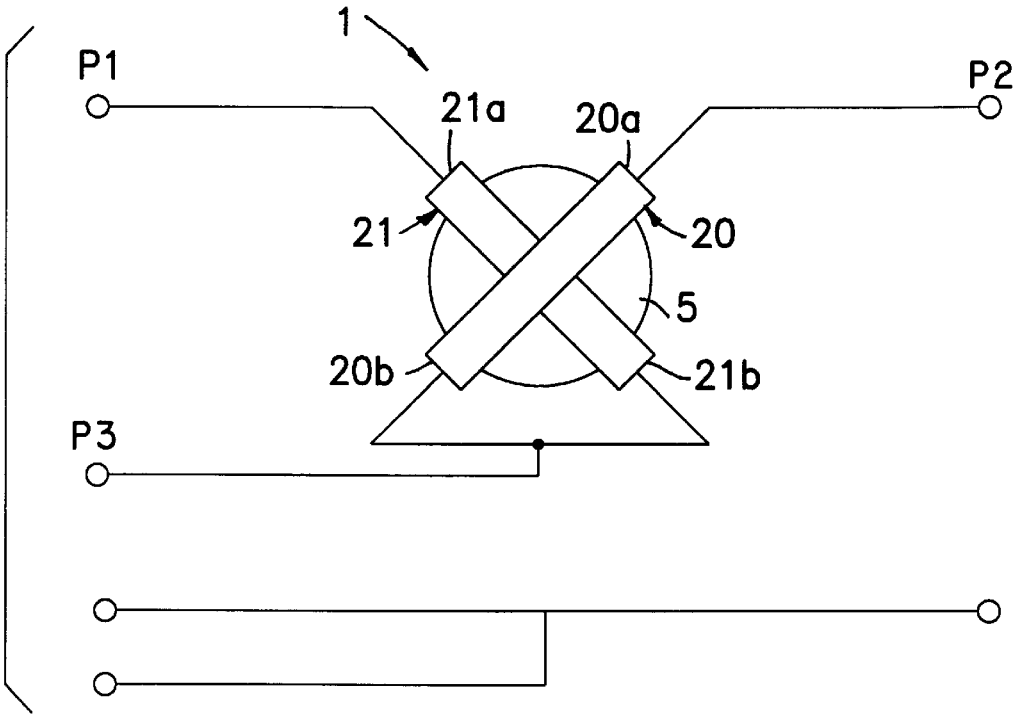
FIG. 3 is an equivalent circuit diagram of the circulator of FIG. 1.

FIG. 1 through FIG. 3 illustrate a circulator according to a first embodiment of the present invention; FIG. 1 and FIG. 2 are exploded perspective views and FIG. 3 is an equivalent circuit diagram of the circulator. FIG. 1 and FIG. 2 are the views of the circulator observed from above.

A lumped-constant circulator 1 shown in FIG. 1 is constructed by: a permanent magnet 3 disposed in a box-shaped lower yoke 2 composed of magnetic metal constituting a magnetic circuit; a dielectric multilayer substrate 4 serving as a central electrode assembly, and a discoid ferrite member 5 which is provided above the permanent magnet 3; and a cap-like upper yoke 6 which is also composed of magnetic metal as is the case with the lower yoke 2 and which is attached to the lower yoke 2. A DC magnetic field is applied to the ferrite member 5 by the permanent magnet 3.

The dielectric substrate 4 is constituted by first through fourth dielectric sheets 7, 8, 10 and 11, each sheet measuring approximately 50 $\mu$m thick. The top surface of each sheet is provided with a predetermined electrode to be described later which is printed and patterned by vapor deposition. These dielectric sheets 7, 8, 10 and 11 are laminated and contact-bonded, then the resulting laminated assembly is sintered into one piece. The first and second dielectric sheets 7 and 8 are provided with holes 12, in which the ferrite member 5 is -inserted, at the centers thereof.

Zonal terminal strips 13 are disposed on two edge's of the first dielectric sheet 7; each strip 13 is formed by being sintered integrally with the laminated assembly. Formed on the two strips 13 are first through third I/O port electrodes P1 through P3 which are exposed outside through openings 6*a* which are formed in the upper yoke 6. The respective port electrodes P1 through P3 are surface-mounted on conductive lines of an external circuit board which is not shown.

A connection electrode 14 is formed on the top surface of the first dielectric sheet 7 and the connection electrode 14 is connected to the I/O electrode P3 via a side electrode 17. Formed on the top surface of the second dielectric sheet 8 shown in the drawing are two connection electrodes 25 and 26 located with the inserting hole 12 therebetween; the connection electrodes 25 and 26 are respectively connected to the remaining I/O port electrodes P1 and P2 via side electrodes 18 and 19.

Zonal central electrodes 20 and 21 are respectively formed on the surfaces of the third and fourth dielectric sheets 10 and 11; the two central electrodes 20 and 21 are arranged so that they are electrically isolated and shifted 90 degrees with respect to each other. First ends 20*a* and 21*a* on one side of the respective central electrodes 20 and 21 are connected to the I/O port electrodes P2 and P1 via through-hole electrodes 22 and 23, respectively. Second ends 20*b* and 21*b* on the other side of the central electrodes 20 and 21 are respectively connected to the connection electrode 14 and the I/O port electrode P3 via through-hole electrodes 24 and through-hole electrode 16.

The ports P1–P3 and electrode 14 are not grounded when the device is to be operated as a non-reciprocal circuit element. For example, no ground is provided in the device shown in FIG. 3. However, the portion 6*a* of the yoke 6 is adjacent to the connection electrode 14 and comes into contact with it when the device is assembled. Further, the port P3 is connected to the connection electrode 14. Thus, when mounted on a printed-circuit board, the yoke 6 must be insulated from ground in order to avoid grounding the port P3 which is connected to the connection electrode 14.

On the other hand, if the yoke 6 is desired to be in contact with an external ground line, a conductive housing, or the like, an insulating material may be provided between the yoke 6 and the connecting electrode 14 in order to avoid grounding the port P3. For example, a dielectric sheet with a resist film thereon (not shown) may be provided between the first dielectric sheet 7 and the terminal strips 13.

The lumped-constant circulator 1 makes use of the non-reciprocal characteristic of the ferrite member 5 in which the phase of dielectric electromotive force differs depending on whether the currents are flowing from the port P1 to the port P2 or from the port P2 to the port P1. The difference in the phase change depends on magnetic force, frequency, and the intersecting angle of the central electrodes 20 and 21. This means that the difference in the phase change can be set to 180 degrees at a design frequency by setting the magnetic force and the intersecting angle of the central electrodes.

The operating principle of the circulator 1 will now be described with reference to FIG. 3.

It is assumed that an electric current which is equal to an input flows from the first I/O port P1 to the third I/O port P3, causing a potential, which is equal to the input in magnitude and nearly equal to the input in phase, to be generated between P3 and P2. It is also assumed that an electric current which is equal to the input flows from the second I/O port P2 to the third I/O port P3, causing a potential, which is nearly equal to the input in magnitude but reversed 180 degrees in phase, to be generated between P3 and P1.

When a signal is supplied through P1, almost all current from P1 flows into P2 and substantially no current flows into P3. At this time, the current flowing from P1 to P3 generates a potential, which has nearly the same phase as that of an input signal, between P3 and P2. Current flowing from P3 to P2 generates a potential of nearly the opposite phase between P1 and P3. This places P1 and P2 at the same potential and the potential at P3 is always approximately zero volts. Hence, the signal applied to P1 is output to P2 without being transmitted to P3.

On the other hand, when a signal is supplied through P2, nearly all current supplied through P2 flows into P3 and substantially no current flows into P1. At this time, only a small potential difference takes place between P2 and P3, meaning that P2 and P3 share nearly the same potential. Current flowing from P2 to P3 generates a potential of approximately the opposite phase from that of the input signal between P3 and P1; therefore, the potential at P1 is always approximately zero volts. Hence, the signal applied to P2 is output to P3 without being transmitted to P1.

Thus, according to the embodiment, the two central electrodes 20 and 21 are so arranged that they intersect with each other, and the I/O ports P1 and P2 are respectively connected to the ends on one side of the two central electrodes 20 and 21 and the remaining I/O port P3 is connected to the ends on the other side thereof. This structure makes it possible to reduce the numbers of the central electrodes, capacitors, and I/O terminal electrodes in comparison with the conventional structure. As a result, one layer of dielectric sheet can be deleted, permitting a smaller sheet area because the capacitor electrode and terminal electrodes which used to be required for the layer can be accordingly omitted. Furthermore, the number of machining steps for the through-hole electrodes can also be reduced, so that the demand for a smaller size and lower price can be fulfilled.

Moreover, since this embodiment has two central electrodes 20 and 21, the ferrite member can be shaped to be rotationally symmetrical in relation to the direction in which the DC magnetic field is applied. This allows the ferrite member to be shaped as a cube or any other desired shape and consequently permits lower component costs without sacrificing the non-reciprocal characteristics.

In the embodiment described above, the central electrodes are formed on the dielectric sheets and the ferrite member is brought into contact therewith; in this invention however, the central electrodes may also be formed within the ferrite member as an alternative. In this case, a plurality of ferrite sheets are formed and the central electrodes are formed by patterning them thereon, then the ferrite sheets are stacked and contact-bonded to produce a laminated body. This configuration enables further reduced size and lower price. In addition, since the ferrite member can be designed to have a desired shape, for example a square shape which can be closely packed, more pieces can be punched out from a mother ferrite sheet, thus leading to a higher yield with a resultant lower price. Moreover, the holes 12 for inserting the ferrite member into the first and second dielectric sheets 7 and 8 can be eliminated.

An experiment which has been carried out to verify the advantage of the present invention will now be described.

Figure 4:
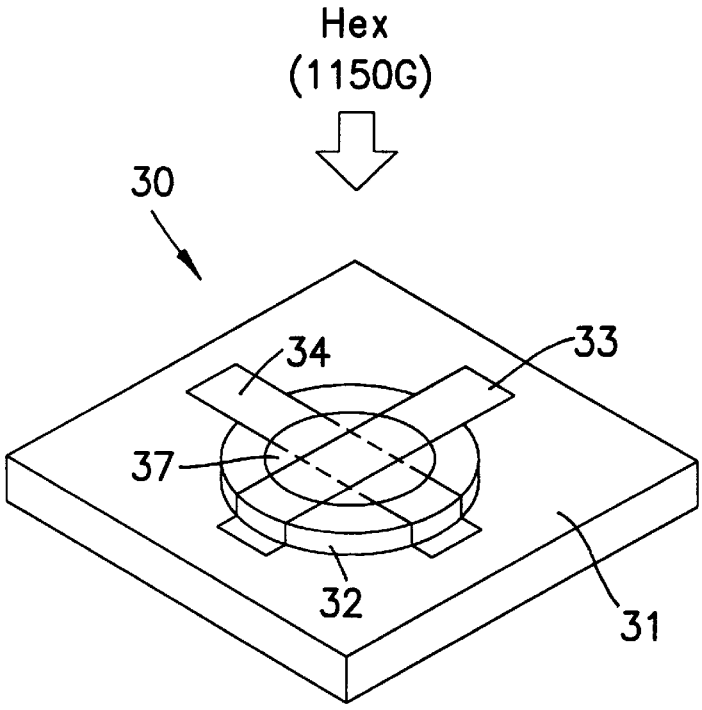
FIG. 4 is a perspective view of a circulator which has been made to verify the advantages of the embodiment of FIG. 1.

In this experiment, as shown in Table 1 and FIG. 4, a circulator has been made in accordance with the present invention and the insertion loss characteristic and the isolation characteristic of the circulator were measured. Table 1 below shows the dimensions of the respective components making up the circulator and the experimental conditions.

TABLE 1

| | Experimental Conditions | |
|---|---|---|
| Ferrite Member | 4 πMs | 800 G |
| | Size | ϕ3.0 mm × t0.3 mm |
| Central Electrode | Line Width | 0.4 mm |
| | Line Length | 3.0 mm |
| Magnetic Circuit | External Magnetic Field | 1150 G |

In a circulator 30 used in this experiment, a ferrite member 32 was disposed on a copper plate 31 and central electrodes 33 and 34 composed of two copper strips were placed on the top surface of the ferrite member 32 with an insulating tape 37 interleaved between them so that they intersect at an angle of 90 degrees with respect to each other, and the ends on one side thereof were connected to the copper plate 31. The equivalent circuit of the circulator 30 was identical to that shown in FIG. 3. An external magnetic field Hex was applied to the ferrite member 32 by an electromagnet. In the experiment, the measurement was performed on the transmitting characteristic between the port P1 and the port P3; the central electrode 34 served as the port P1, while the copper plate 31 served as the port P3.

Figure 5A:
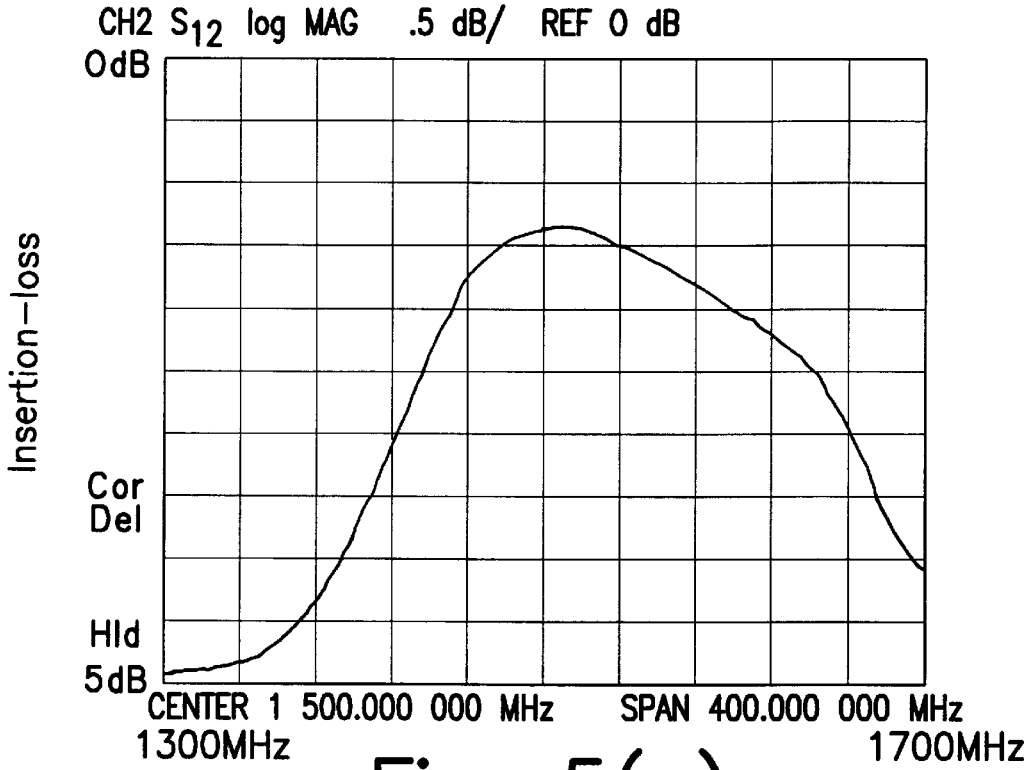
FIGS. 5(*a*) and 5(*b*) show characteristic curves illustrating the characteristics of the aforesaid circulator.
Figure 5B:
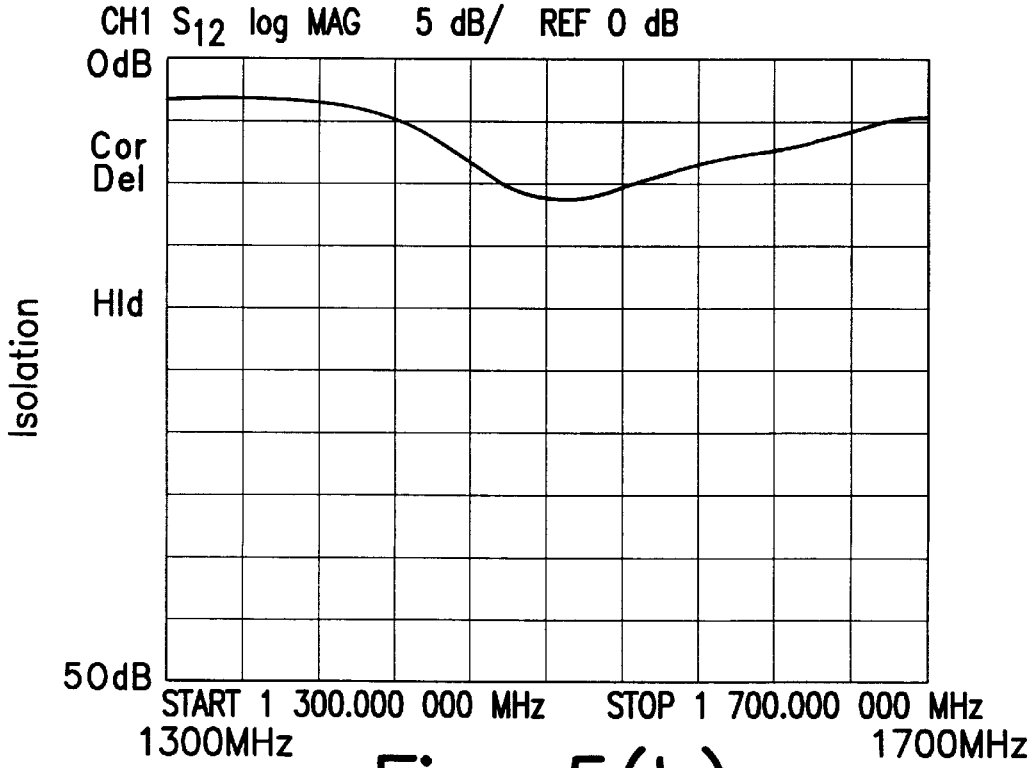

FIG. 5(*a*) shows the measurement result of the insertion loss characteristic of the circulator 30; and FIG. 5(*b*) shows the measurement result of the isolation characteristic. As shown by the characteristic curves, the circulator 30 has exhibited satisfactory values in both insertion loss characteristic, which represents the signal transmission loss characteristic, and isolation characteristic which represents the attenuation in the opposite direction.

Figure 6:
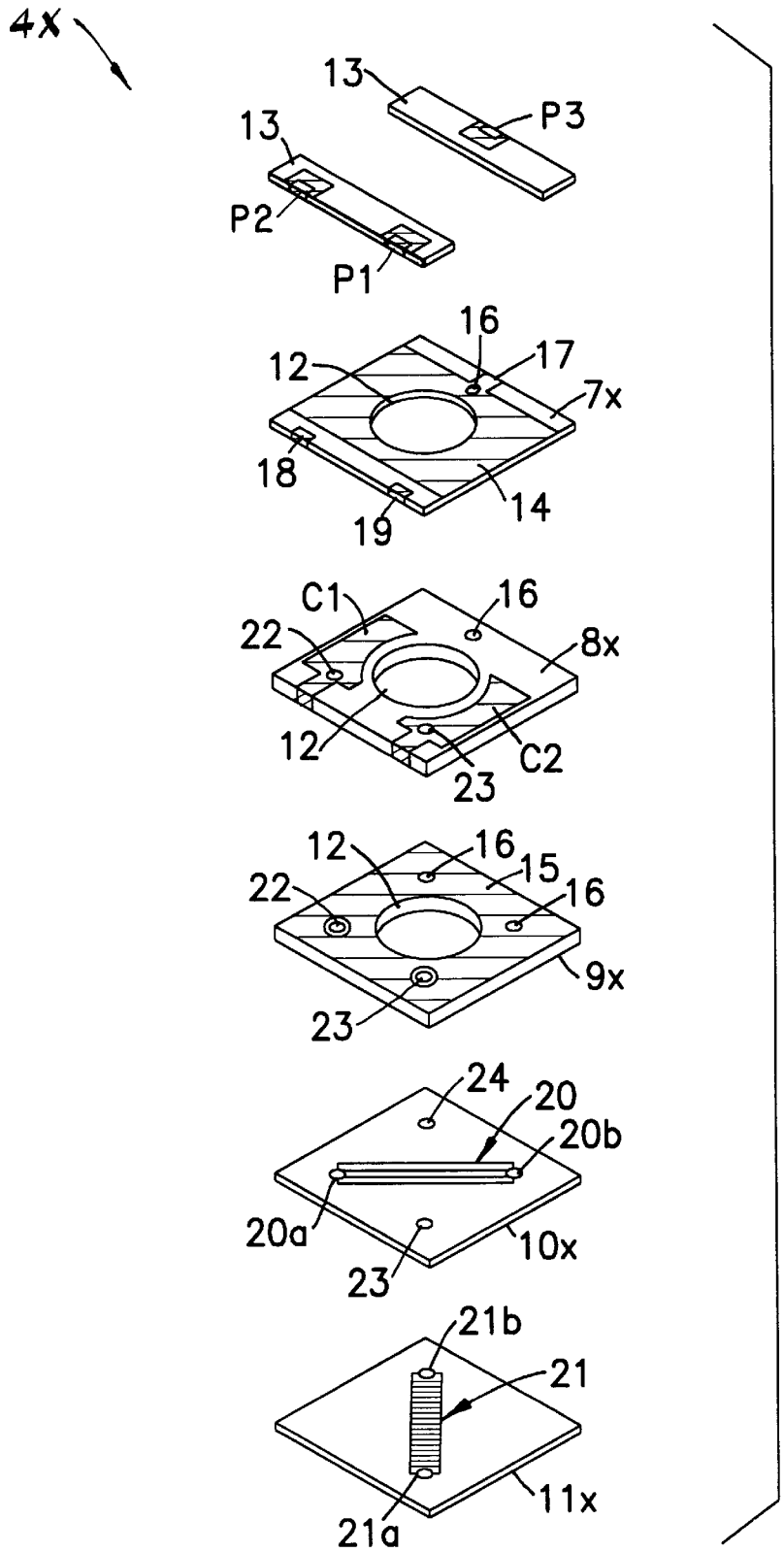
FIG. 6 is an exploded perspective view illustrating a circulator according to a second embodiment of the present invention.

FIG. 6 is a diagram which illustrates a circulator in accordance with a second embodiment of the present invention. Like reference numerals in the drawing corresponding to those shown in FIG. 2 denote like or corresponding components. The circulator shares the same basic structure as that shown in FIG. 2; therefore, only the different sections of the dielectric multilayer substrate 4*x* will be described.

The foregoing dielectric substrate 4*x* is constituted by first through fifth dielectric sheets 7*x* through 1*x*, each sheet measuring approximately 50 μm thick; the top surface of each sheet is provided with a predetermined electrode to be described later which is printed and patterned by vapor deposition. These dielectric sheets 7*x* through 11*x* are laminated and contact-bonded, then the resulting laminated assembly is sintered as one piece. The first through third dielectric sheets 7*x* to 9*x* are provided with holes 12, in which the ferrite member 5 is inserted, at the centers thereof.

Zonal terminal strips 13 are disposed on two edges of the first dielectric sheet 7*x*; each strip 13 is formed by being sintered integrally with the laminated assembly. Formed on the two sheets 13 are the first through third I/O port electrodes P1 through P3 which are exposed outside through openings 2*a* and 6*a* which are formed in the upper yoke 2 and the lower yoke 6, respectively. The respective port electrodes P1 through P3 are surface-mounted on an electrode line of an external circuit board which is not shown.

A capacitor electrode 14 and a capacitor electrode 15 are formed on the top surfaces of the first dielectric sheet 7*x* and the third dielectric sheet 9*x*, respectively; the respective capacitor electrodes 14 and 15 are connected to the I/O port electrode P3 via a plurality of through-hole electrodes 16 and a side electrode 17. Capacitances are generated between the capacitor electrode 14 and C1, C2 and between the capacitor electrode 15 and C1, C2. Formed on the top surface of the second dielectric sheet 8*x* shown in the drawing are two capacitor electrodes C1 and C2 which surround the inserting holes 12; the two capacitor electrodes C1 and C2 are respectively connected to the remaining I/O port electrodes P2 and P1 via side electrodes 18 and 19.

Zonal central electrodes 20 and 21 are respectively formed on the surfaces of the fourth and fifth dielectric sheets 10 and 11; the two central electrodes 20 and 21 are arranged so that they are electrically isolated and shifted 90 degrees with respect to each other. Ends 20*a* and 21*a* on one side of the respective central electrodes 20 and 21 are connected to the I/O port electrodes P2 and P1 via through-hole electrodes 22 and 23, respectively. Ends 20*b* and 21*b* on the other side of the central electrodes 20 and 21 are respectively connected to the capacitor electrodes 15, 14, and the I/O port electrode P3 via a through-hole electrode 24 and the through-hole electrode 16, respectively. The capacitor electrodes C2 and C1 are connected between the ends 20*a*, 21*a* on one side and the ends 21*b*, 20*b* on the other side.

Such a lumped-constant circulator allows the difference in the phase change to be set to 180 degrees at a design frequency by setting the magnetic force and the intersecting angle of the central electrodes as is the case with the circulator shown in FIG. 2 described above.

Figure 7:
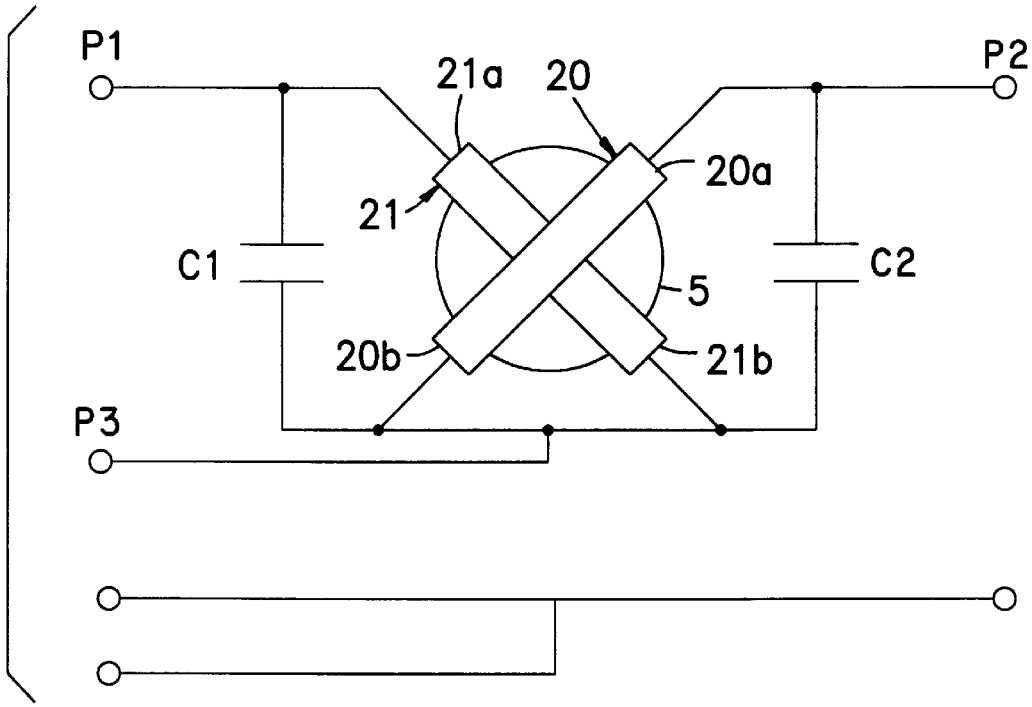
FIG. 7 is an equivalent circuit diagram illustrating the circulator of FIG. 6.

The foregoing circulator will now be described in conjunction with FIG. 7 which is an equivalent circuit diagram of the circulator. As illustrated in FIG. 7, matching capacitors C1 and C2 are connected in parallel between the first I/O port P1 and the third I/O port P3, and between the second I/O port P2 and the third I/O port P3, thereby permitting the matching between the circulator and the electronic circuits and electronic components connecting the circulator at a design frequency.

Thus, as is the case with the circulator shown in FIG. 2, this embodiment also makes it possible to reduce the number of the central electrodes, capacitors, and I/O terminal electrodes in comparison with the conventional structure. The laminated dielectric substrate becomes higher than that in the structure illustrated in FIG. 2 because of the additional dielectric sheet forming the capacitor electrode; however, the height is only about 50 μm and the height of the circulator will not be increased much.

As is the case with the circulator shown in FIG. 2, in the above embodiment also, the central electrodes are formed on the dielectric sheet and brought, in contact with the ferrite member; however, the central electrodes may alternatively be formed within the ferrite member. Such a configuration enables further reduced size and lower price as is the case with the circulator shown in FIG. 2. In addition, since the ferrite member can be designed to have a desired shape, more pieces can be punched out from a mother ferrite sheet, thus leading to a higher yield with a resultant lower price.

The ferrite sheet may be used only as the sheet for forming the central electrodes or it may also be used as the sheet for forming the capacitor electrodes; the ferrite sheet and the dielectric sheet may be combined in any desired manner.

The following will describe an experiment which has been carried out to verify the advantages of this embodiment.

Figure 8:
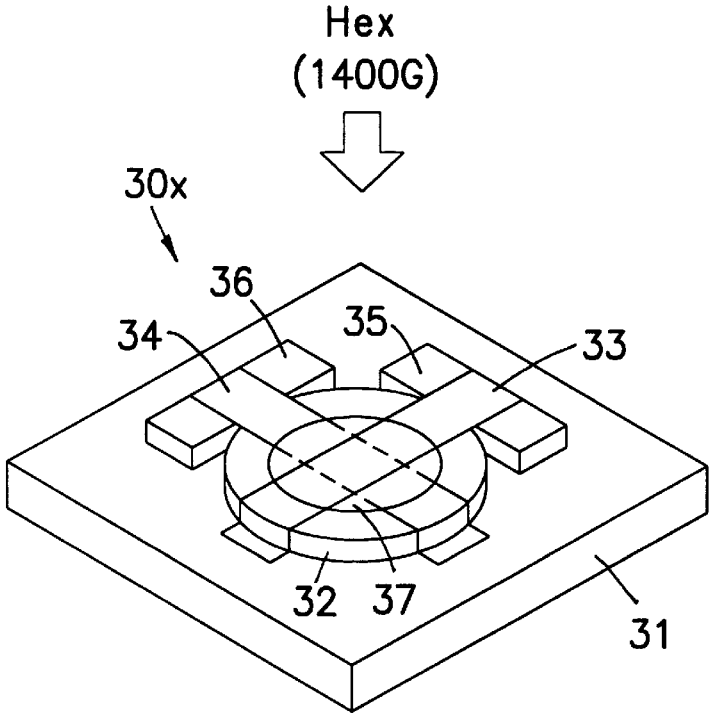
FIG. 8 is a perspective view of a circulator which has been created to verify the advantages of the embodiment of FIG. 6.

In this experiment, as shown in Table 2 and FIG. 8, a circulator has been made in accordance with the present invention and the insertion loss characteristic and the isolation characteristic of the circulator were measured. Table 2 below shows the dimensions of the respective components making up the circulator and the experimental conditions.

TABLE 2

| | Experimental Conditions | |
|---|---|---|
| Ferrite Member | 4 πMs | 800 G |
| | Size | φ3.0 × 0.3 |
| Central Electrode | Line Width | 1.0 mm |
| | Line Length | 3.0 mm |
| Capacitor | Capacitance | 7 pF |
| Magnetic Circuit | External Magnetic Field | 1400 G |

In a circulator 30*x* used in this experiment, a ferrite member 32 was disposed on a copper plate 31 and central electrodes 33 and 34 composed of two copper strips were placed on the top surface of the ferrite member 32 with an insulating tape 37 interleaved between them so that they intersect at an angle of 90 degrees with respect to each other. Chip capacitors 35 and 36 were respectively connected to the ends on one side of the central electrodes 33 and 34; the ends on the other side thereof were connected to the copper plate 31. The equivalent circuit of the circulator 30 was identical to that shown in FIG. 7. An external magnetic field Hex was applied to the ferrite member 32 by an electromagnet. In the experiment, the measurement was performed on the transmitting characteristic between the port P1 and the port P3; the central electrode 34 served as the port P1 and the copper plate 31 served as the port P3.

Figure 9A:
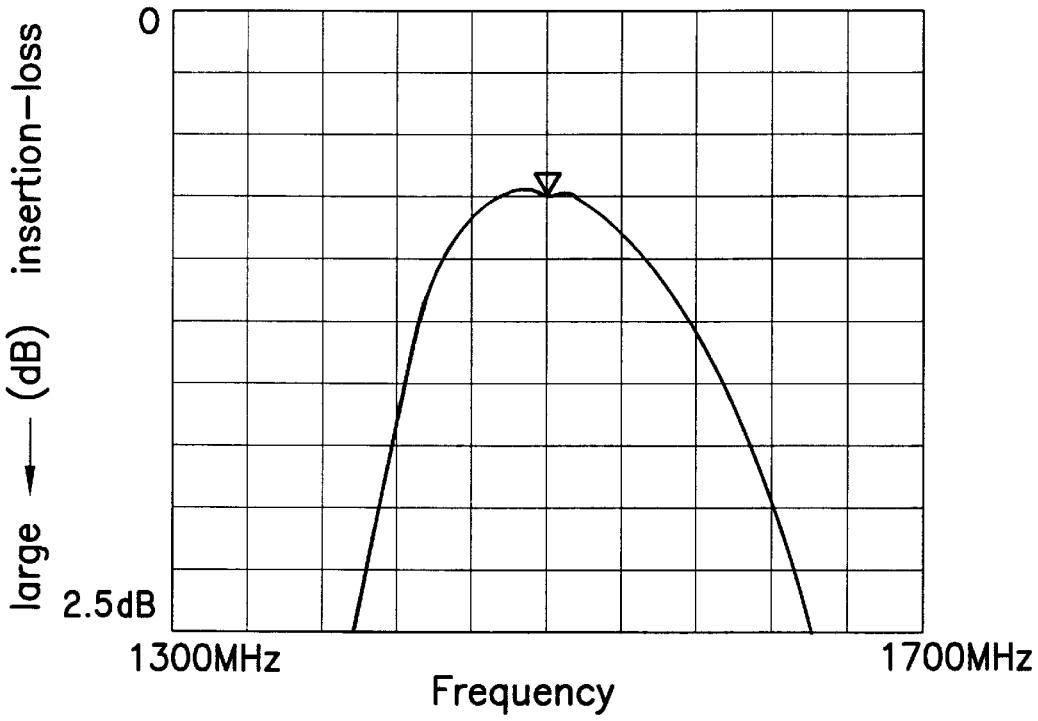
FIG. 9(*a*) and 9(*b*) show characteristic curves illustrative of the characteristics of the circulator of FIG. 6.
Figure 9B:
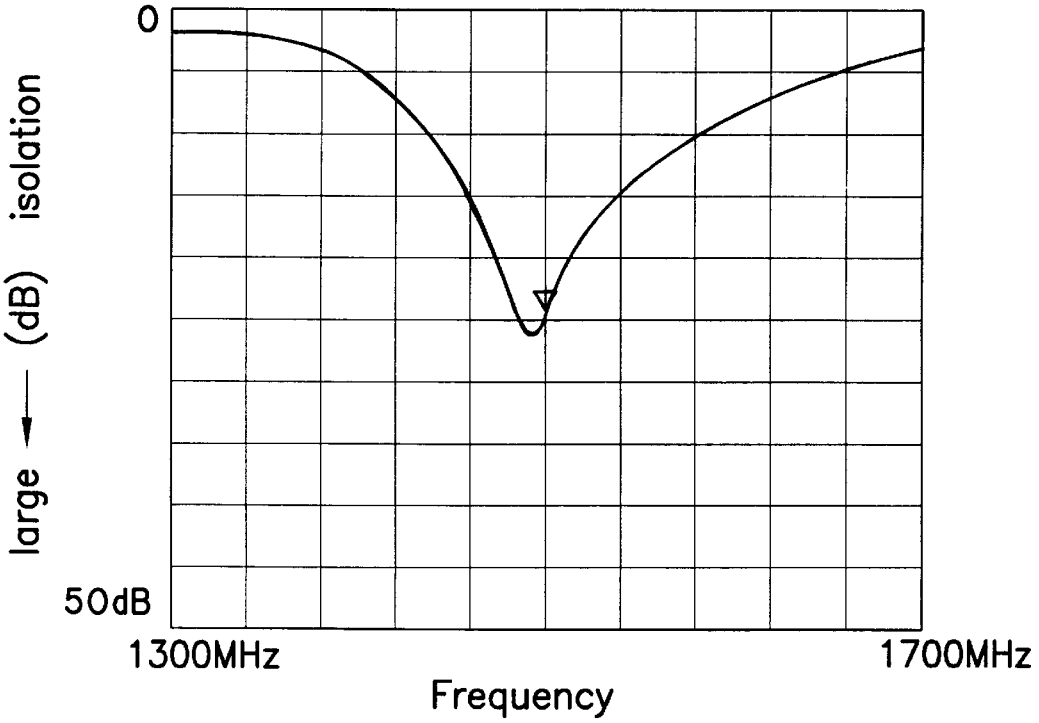

FIG. 9(*a*) and FIG. 9(*b*) are characteristic charts which show the measurement result of the insertion loss characteristic and the isolation characteristic, respectively. As shown by the characteristic curves, the circulator 30*x* has exhibited satisfactory values in both insertion loss characteristic, which represents the signal transmission loss characteristic, and isolation characteristic which represents the attenuation in the opposite direction.

Figure 10:
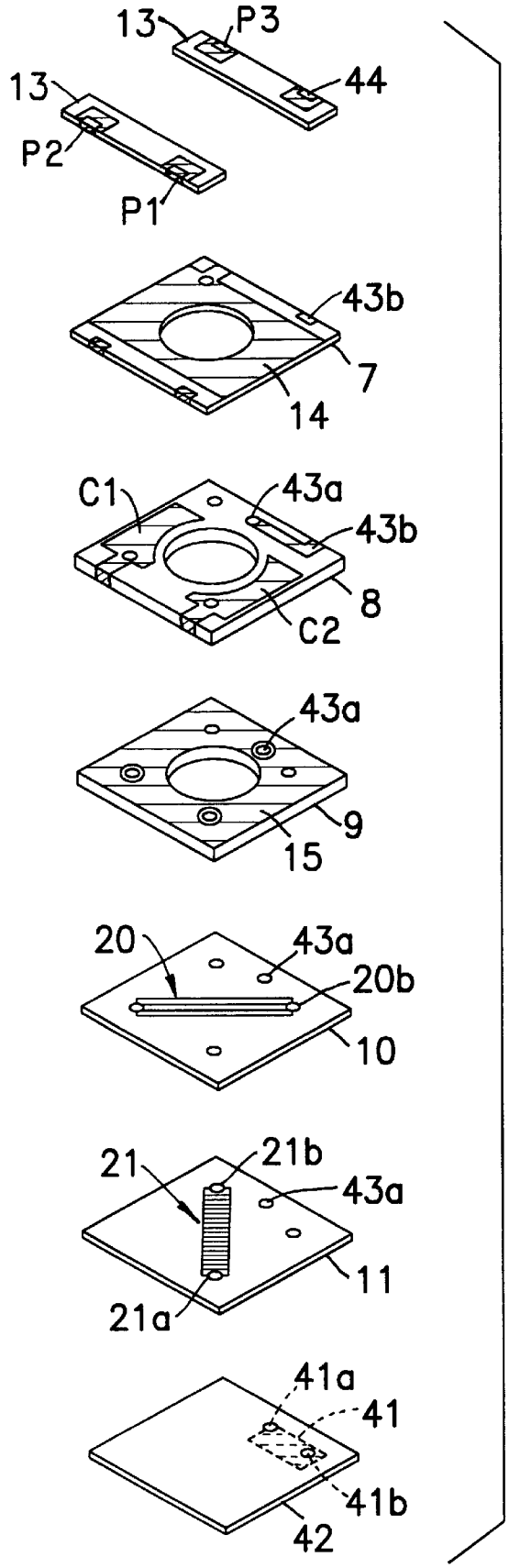
FIG. 10 is an exploded perspective view illustrative of an isolator according to a third embodiment according to the present invention.

FIG. 10 is a diagram which illustrates an isolator in accordance with a third embodiment of the present invention. Like reference numerals in the drawing corresponding to those shown in FIG. 2 and FIG. 6 denote like or corresponding components. The isolator shares the same basic structure as that shown in FIG. 2 and FIG. 6; therefore, only different sections will be described.

An isolator 40 according to this embodiment has a terminating resistance film 41 which is connected to the I/O port P3; the terminating resistance film 41 is formed on a sixth dielectric sheet 42 disposed under the fifth dielectric sheet 11. One end 41*a* is connected to a GND electrode 44 via through-hole electrodes 43*a* and a side surface electrode 43*b;* the other end 41*b* is connected to the I/O port P3 via the other ends 20*b* and 21*b* of the central electrodes 20 and 21 and the capacitor electrodes 15 and 14, respectively. Hence, the isolator 40 according to the embodiment has the structure wherein a resistor has been added to the I/O port P3 of the circulator shown in FIG. 7. Although the resistor has been connected to the I/O port P3 of the circulator illustrated in FIG. 7 in this embodiment, no matching capacitor would be required if matching is made with an external circuit; therefore, the resistor may be connected, for example, to the I/O port P3 of the circulator shown in FIG. 3.

In this embodiment, the two central electrodes 20 and 21 are disposed and the terminating resistance film 41 is connected to the single I/O port P3, making it possible to reduce the numbers of the central electrodes, capacitors, and I/O terminal electrodes in comparison with the conventional isolator and thus to respond to the demand for a reduced size and a lower price. Accordingly, this embodiment is capable of providing the same advantage as that accomplished by the embodiment described above.

Moreover, unlike the two-terminal isolator disclosed in Japanese Unexamined Patent Publication No. 52-134349, this embodiment does not have any resistor connected to the I/O port P1; therefore, a potential difference, if any, between the I/O port P1 and the I/O port P2 would not cause a loss at the resistor. Accordingly, there will be no problem of the deterioration in the insertion loss characteristic.

Figure 11:
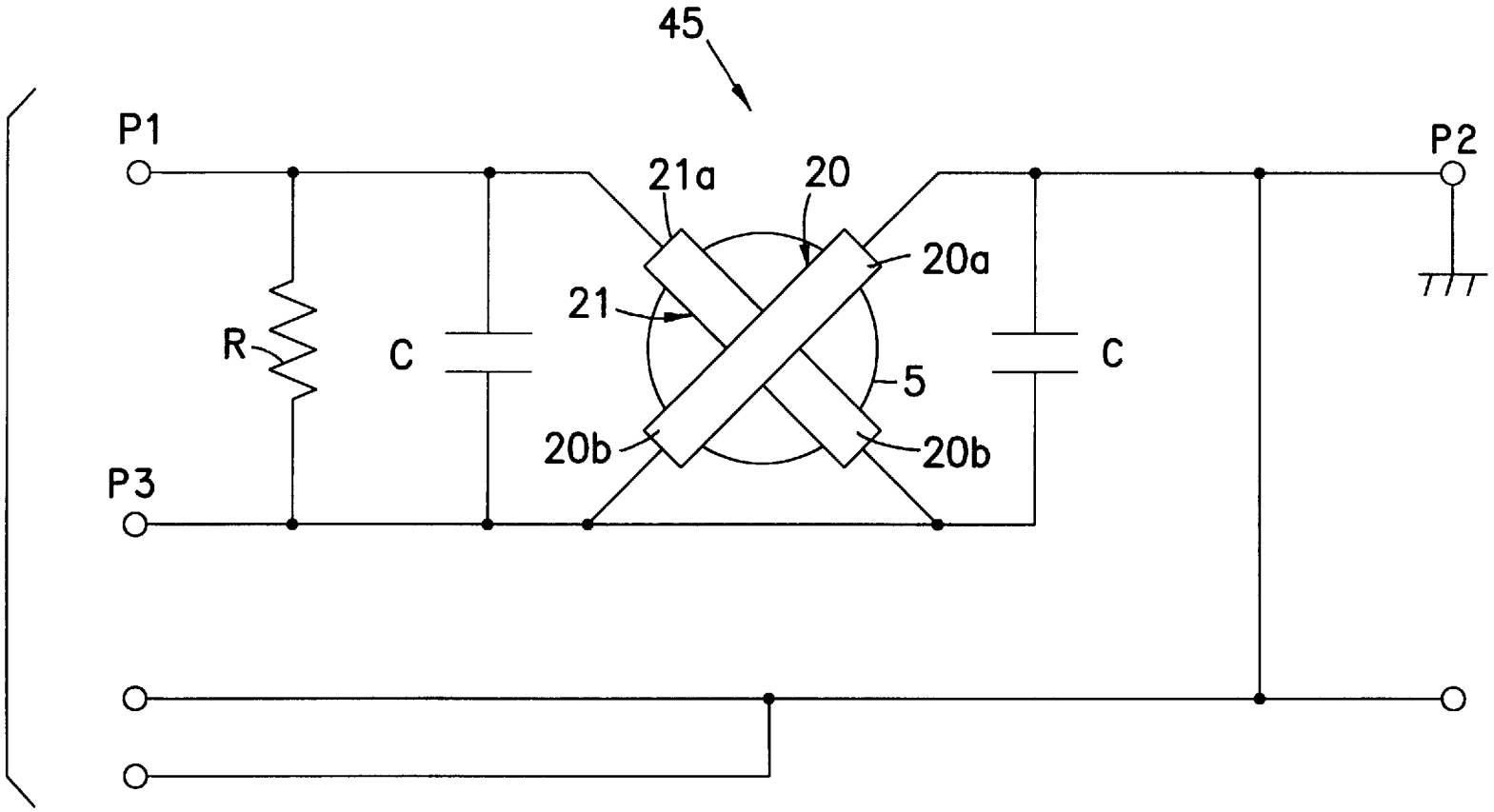
FIG. 11 is an equivalent circuit diagram illustrative of an isolator according to a fourth embodiment of the present invention.

FIG. 11 is a diagram illustrative of an isolator in accordance with a fourth embodiment of the present invention. Like reference numerals in the drawing as those shown in FIG. 7 denote like or corresponding components. The isolator shares the same basic circuit configuration as that shown in FIG. 7; therefore, only different sections will be described.

The isolator 45 is constituted by connecting the single I/O port P2 to the ground and by connecting a resistor R of a resistance value, which is approximately equal to the terminal impedance, in parallel between the remaining I/O ports P1 and P3. In this embodiment, the resistor may alternatively be connected in parallel between the ports P2 and P3 and the port P1 may be grounded; or the resistor may be connected in parallel between the ports P1 and P2 and the port P3 may be grounded.

The operating principle of the isolator 45 will be described in conjunction with FIG. 11.

When a signal is supplied through P1, the currents flow from P1 to P3 via the resistor R. At this time, the currents do not flow from Pi to P3 via the central electrodes 21 and 20; therefore, no inductive electromotive force is generated between P2 and P3. Hence, P2 and P3 will be at nearly the same potential and the potential at P3 is always approximately zero volts. Thus, the potential difference between P1 and P3 will be nearly equal to that between P1 and ground, causing the signal, which has been entered through P1, to be absorbed by the resistor R.

As mentioned in the foregoing embodiment, when the circulator receives the signal through P3, the potential at P1 and P3 stays nearly the same at all times and the potential at P2 is always approximately zero volts. Accordingly, even if the resistor is connected between P1 and P3, the potential at both ends of the resistor is always nearly the same and therefore, little current flows through the resistor. Further, whether P2 is short-circuited to the ground or not, the potential thereof will be approximately zero volts at all times. Hence, this embodiment exhibits almost the same transmitting characteristic as that of the embodiments previously described; the signal applied to P3 is output to P1. Such an operation applies to other combinations of the ports.

In this embodiment, the resistor R is connected in parallel between the two I/O ports P1 and P3, making it possible to reduce the numbers of the central electrodes, capacitors, and I/O terminal electrodes in comparison with the conventional isolator and thus to respond to the demand for a reduced size and a lower price. Accordingly, this embodiment is capable of providing the same advantages as that accomplished by the embodiments described above. Moreover, this embodiment permits further reduced cost since it obviates the need of the GND electrodes in comparison with the isolators described above.

Figure 12A:
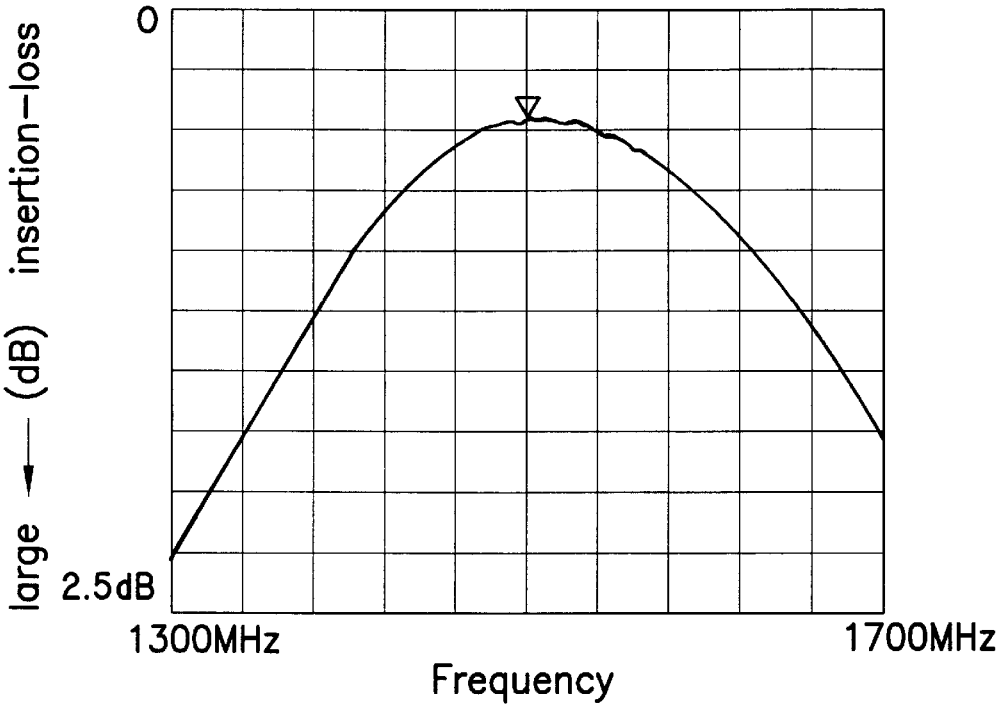
FIGS. 12(*a*) and 12(*b*) show characteristic curves illustrative of the characteristics of the isolator of FIG. 11.
Figure 12B:
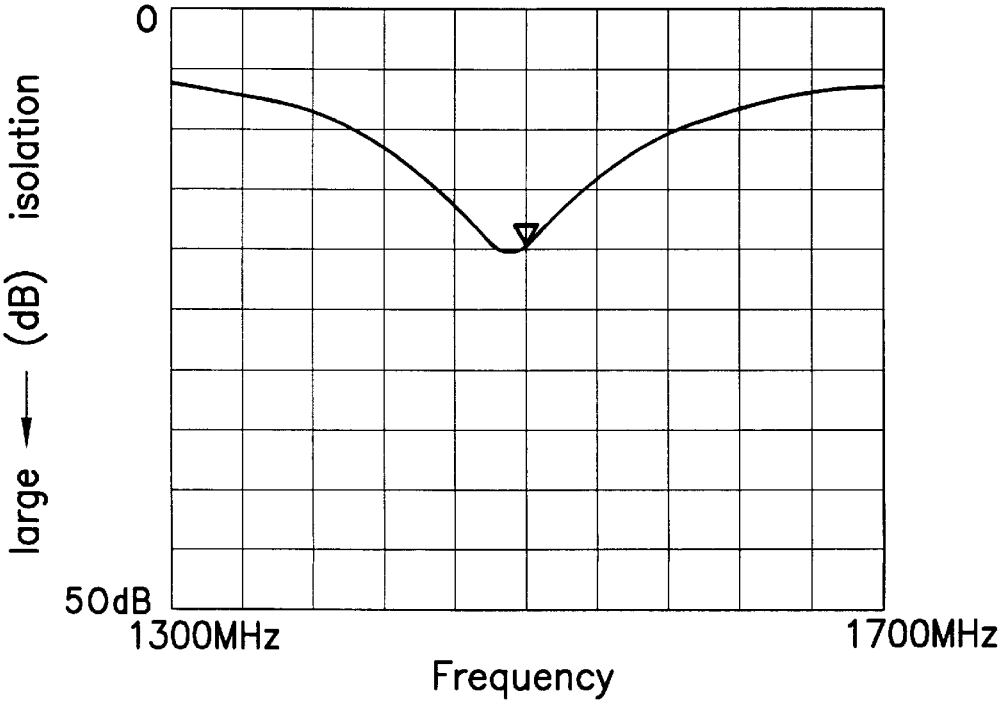

FIG. 12(*a*) shows the measurement result of the insertion loss characteristic of the isolator 45; and FIG. 12(*b*) shows the measurement result of the isolation characteristic. The measurement was performed by connecting a resistor of 50 ohms in parallel between the ports P1 and P3, and by short-circuiting the port P2 by grounding it. As shown by the characteristic curves, the isolator 45 has exhibited satisfactory values in both characteristics.

Figure 13:
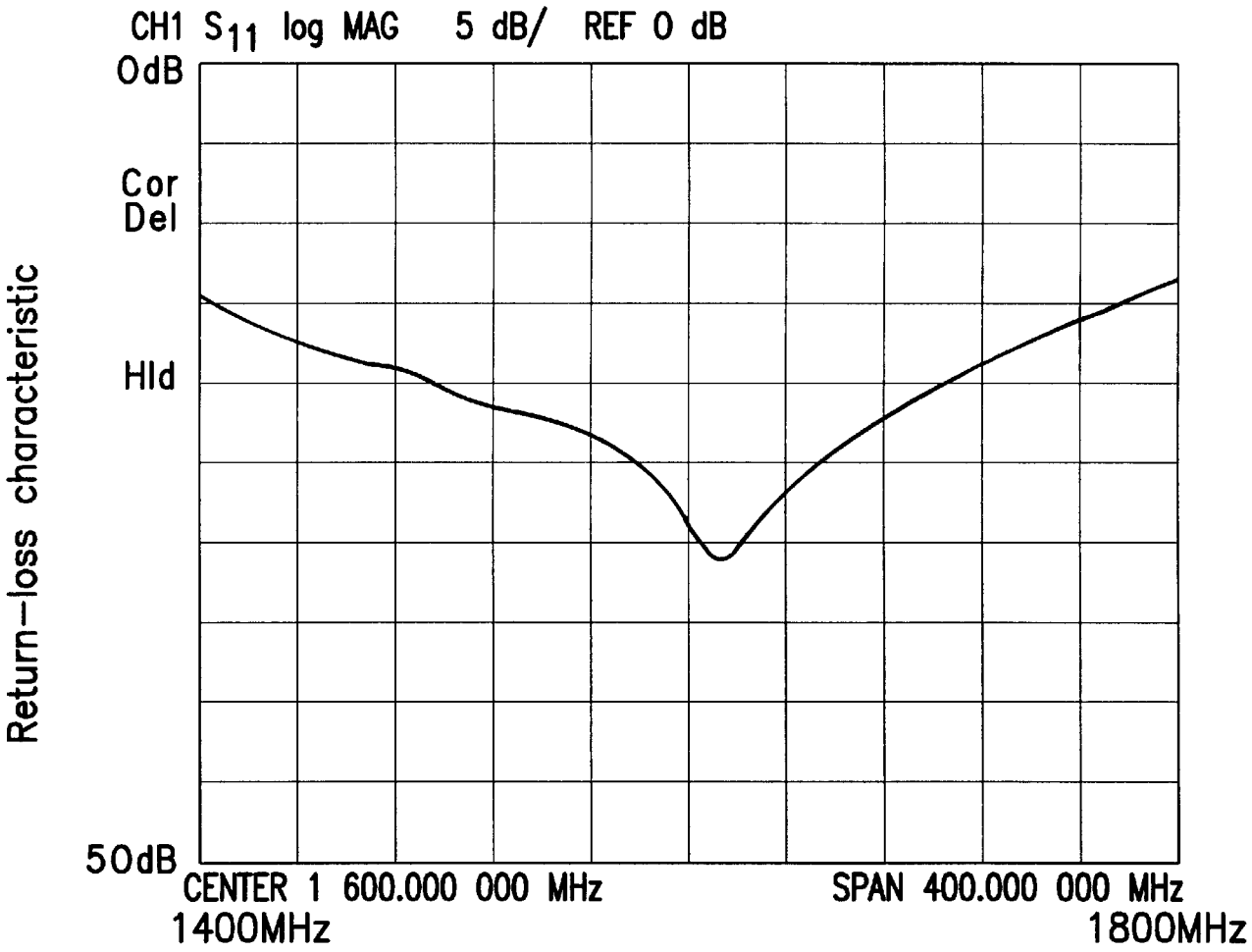
FIG. 13 is a return loss characteristic chart illustrative of the characteristic of the isolator of FIG. 11.
Figure 14:
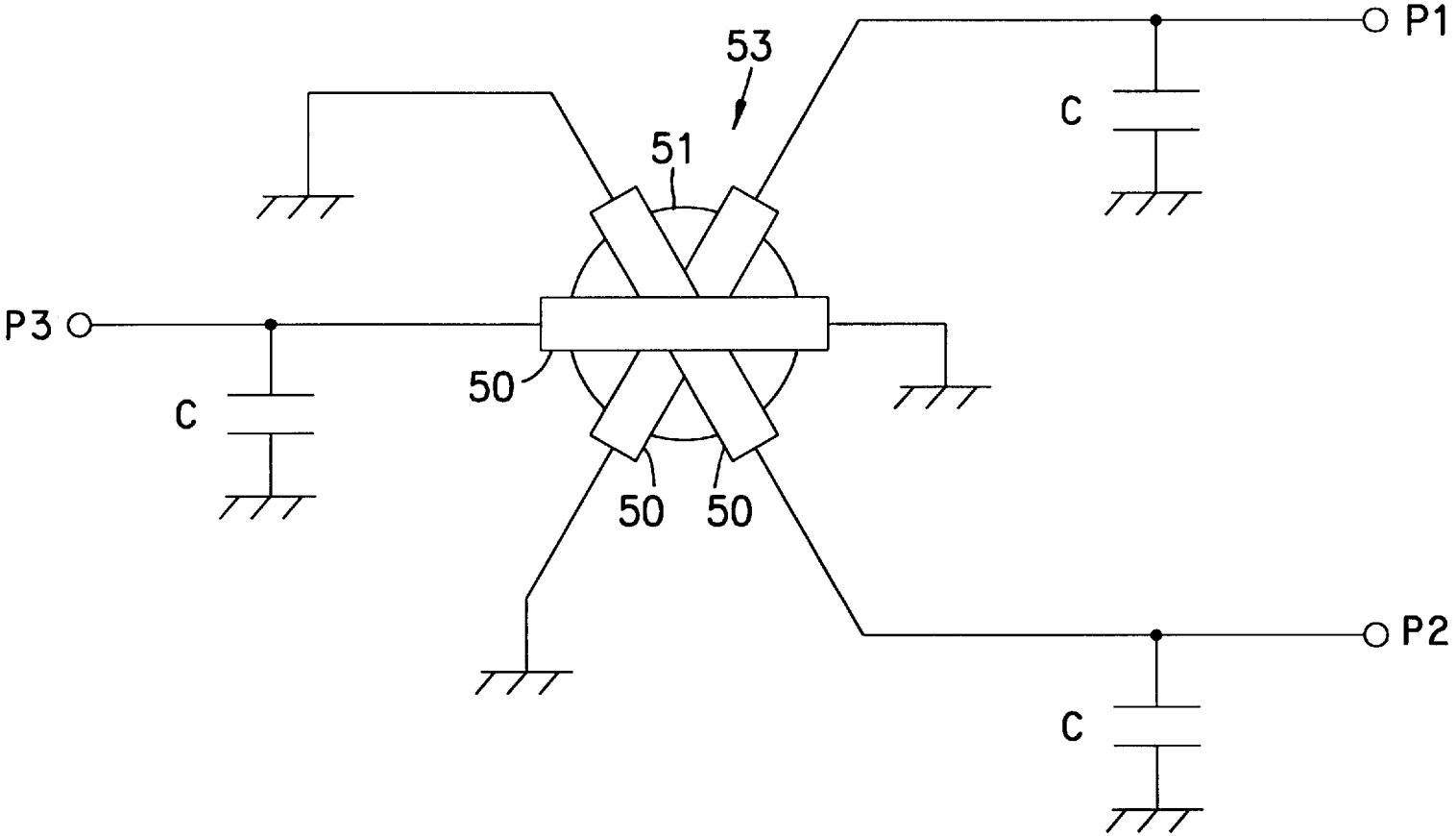
Fig. 14 PRIOR ART
FIG. 14 is an equivalent circuit diagram of a conventional circulator.
Figure 15:
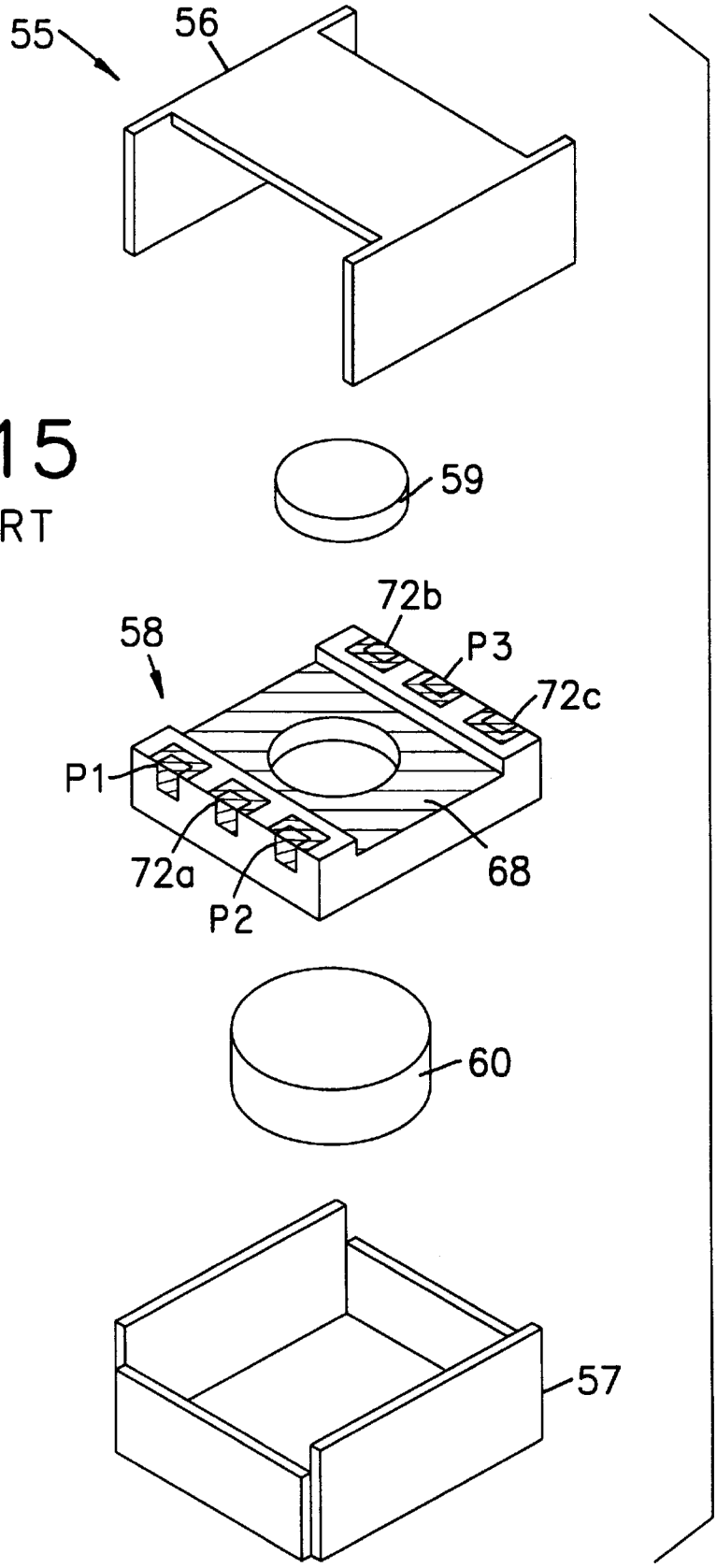
Fig. 15 PRIOR ART
FIG. 15 is an exploded perspective view of another conventional circulator.
Figure 16:
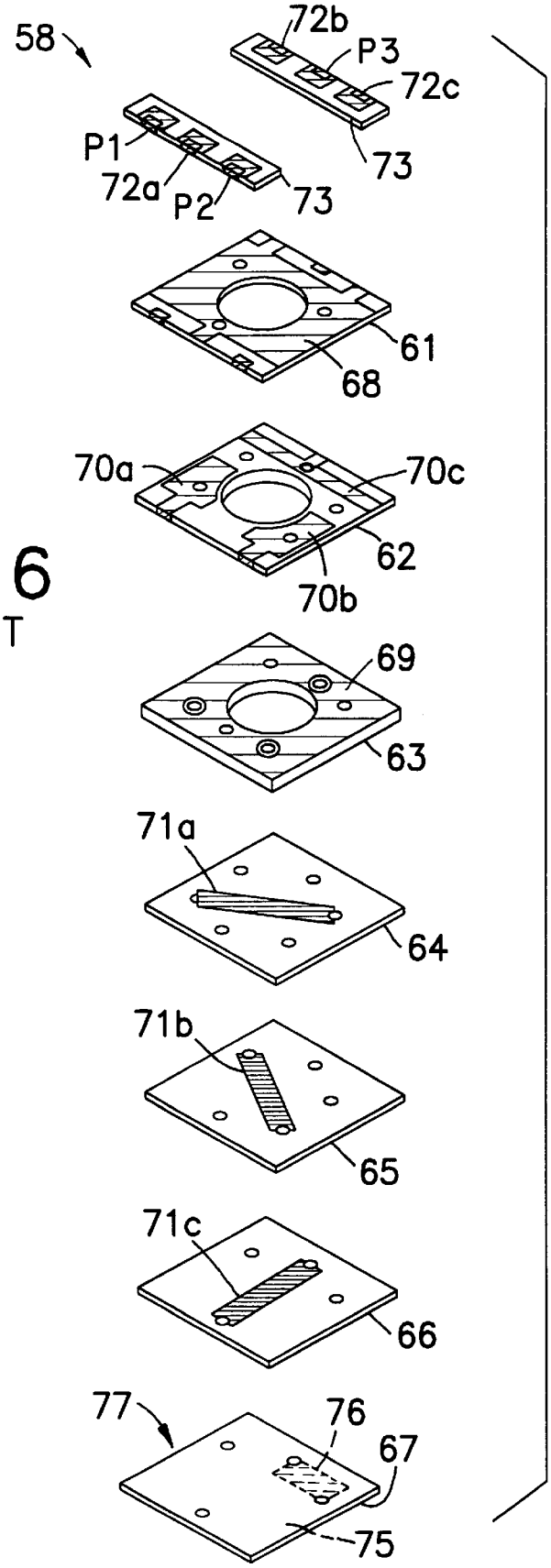
Fig. 16 PRIOR ART
FIG. 16 is an exploded perspective view of a conventional dielectric substrate.
Figure 17:
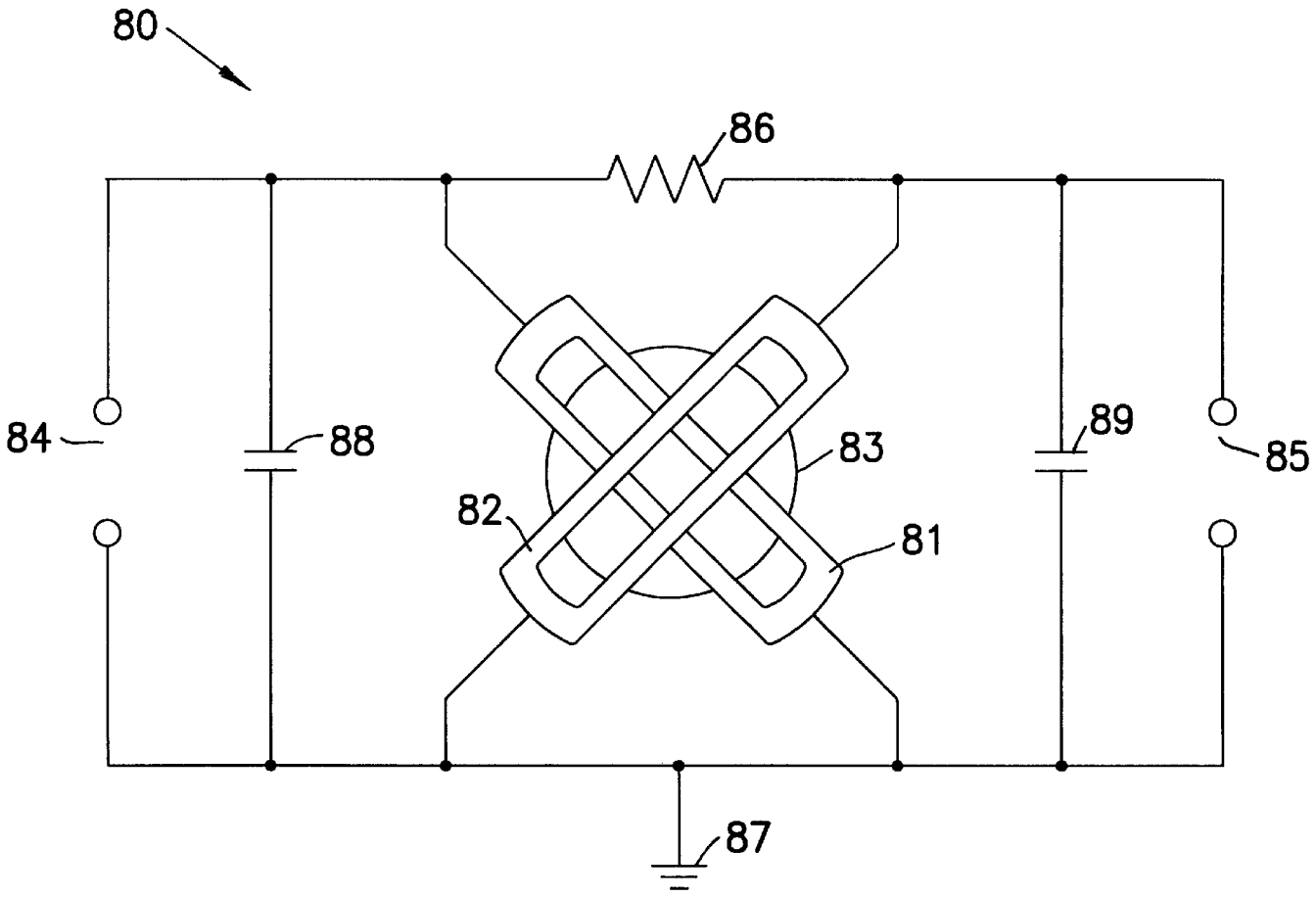
Fig. 17 PRIOR ART
FIG. 17 is a partially schematic diagram of a conventional two-terminal isolator.
Figure 18:
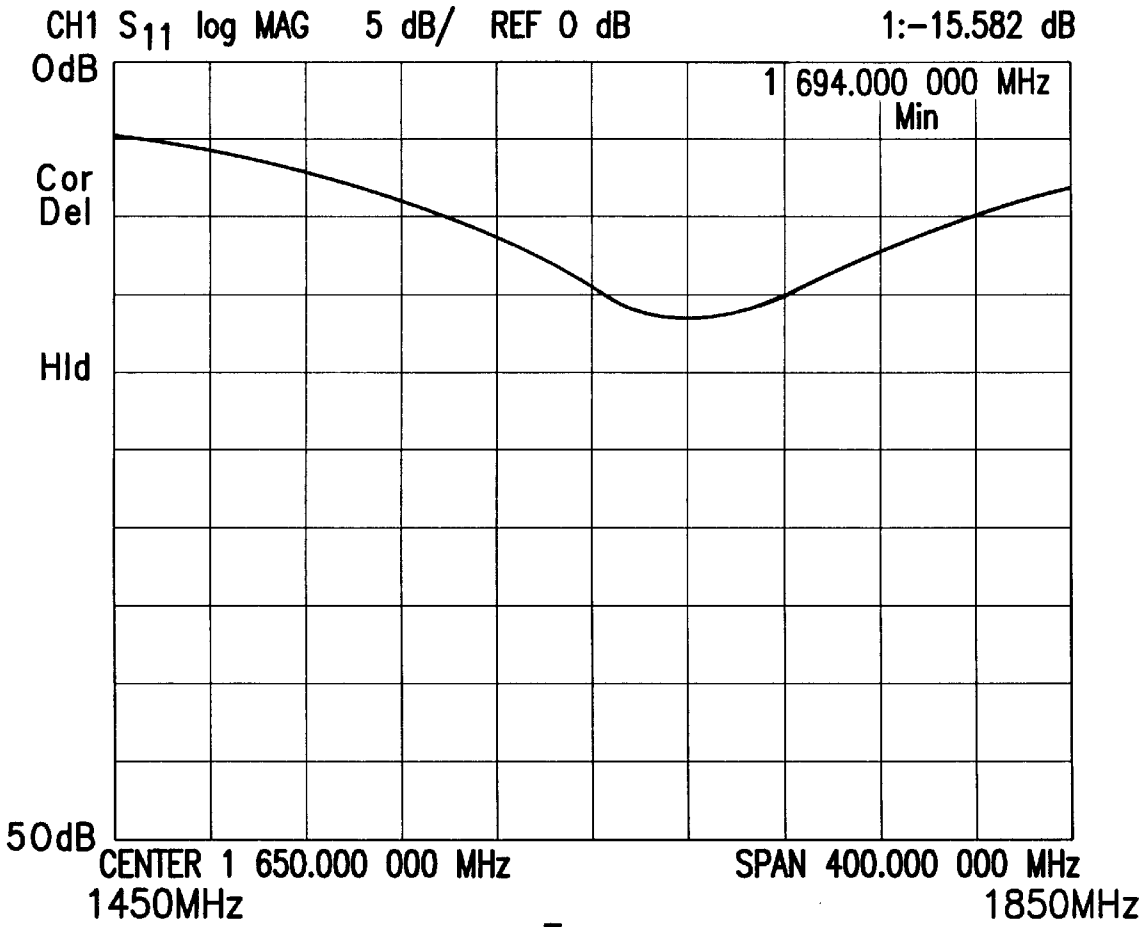
Fig. 18 PRIOR ART
FIG. 18 is a return loss characteristic chart of the isolator of FIG. 17.

In this embodiment, since the resistors are connected to the I/O port P1 and the I/O port P3, the loss at the resistors takes place due to the potential difference between the I/O port P1 and the I/O port P3 as is the case with the two-terminal isolator disclosed in Japanese Unexamined Patent Publication No. 52-134349. This embodiment, however, provides a given return loss characteristic over a wider range than that provided by the prior art disclosed in Japanese Unexamined Patent Publication No. 52-134349. More specifically, as shown in FIG. 13, the return loss characteristic value of 15 dB can be obtained over a 220 MHZ range rather than about 100 MHZ which is obtained by the two-terminal isolator described in Japanese Unexamined Patent Publication No. 52-134349.

Thus, in the non-reciprocal circuit element in accordance with the present invention, the two central electrodes intersecting each other are disposed on the main surface of or within the ferrite member, the I/O ports are connected to the ends on one side of the two central electrodes and one I/O port is connected to the ends on the other side thereof. This permits a reduction in the numbers of the central electrodes, the capacitors, and the I/O terminal electrodes, offering the advantages of a reduced size and a lower price of the non-reciprocal circuit element constructed by the components.

In a preferred form according to the present invention, the matching circuit has been added by connecting a capacitor between the first and second I/O ports and the third I/O port, thus permitting easier matching with an external circuit.

In another preferred form according to the present invention, the terminating resistor is connected to any one of the I/O ports, thus providing an advantage of permitting a smaller and cheaper isolator.

Advantageously, the insertion loss characteristic is not deteriorated due to a potential difference between an input port and an output port. This advantage is not available with the two-terminal isolator described in Japanese Unexamined Patent Publication No. 52-134349.

In another preferred form according to the present invention, any one of the I/O ports is connected to the ground, and the remaining two I/O ports are provided with the resistor which has a resistance value approximately equal to the impedance of the ports and which is connected in parallel between the two ports. This also provides an advantage of a smaller and cheaper isolator. There is also an advantage in that the isolator according to the present invention permits a broader bandwidth with a given return loss characteristic.

In a further preferred form according to the present invention, the central electrodes are stacked alternately with the insulating sheets interleaved therebetween to form a laminated assembly. This configuration is advantageous for achieving higher density which permits a reduced size.

In another preferred form according to the present invention, the respective I/O port electrodes to which the respective central electrodes are connected are formed on the outer surface of the foregoing laminated assembly. This configuration advantageously permits a still higher density with a resultant further reduced size.

In a further preferred form according to the present invention, the insulating sheets are composed of ferrite to provide an advantage of enabling a still higher density of components mounted, with a resultant further reduced size.

Although the present invention has been described in relation to particular embodiments thereof, many other variations and modifications and other uses will become apparent to those skilled in the art. Therefore, the present invention is not limited by the specific disclosure herein.

What is claimed is:

1. A non-reciprocal circuit element comprising:

a central electrode assembly composed of first and second central electrodes which are disposed on a ferrite member in such a manner that they intersect with each other while being electrically insulated from each other, said first and second central electrodes each having respective first and second ends;

first and second I/O ports which are respectively connected to corresponding first ends of the first and second central electrodes, and a third I/O port which is connected in common to both of the second ends of the first and second central electrodes;

a matching circuit comprising at least one capacitor connected between one of said first and second I/O ports and said third I/O port; and a magnetic circuit for applying a DC magnetic field to said ferrite member.

2. A non-reciprocal circuit element according to claim 1, further comprising a terminating resistor connected to any one of the I/O ports.

3. A non-reciprocal circuit element according to claim 2, wherein said terminating resistor is connected between said first and third I/O ports.

4. A non-reciprocal circuit element according to claim 3, wherein said second I/O port is grounded.

5. A non-reciprocal circuit element according to claim 1, wherein said central electrode assembly is composed of said central electrodes which are stacked alternately with insulating sheets interleaved between said central electrodes to form a laminated body.

6. A non-reciprocal circuit element according to claim 5, wherein said respective I/O port electrodes are disposed on the outer surface of said laminated body.

7. A non-reciprocal circuit element according to claim 5, wherein said insulating sheets are composed of ferrite.

8. A non-reciprocal circuit element according to claim 1, wherein said at least one capacitor is connected between said first and third I/O ports, and further comprising a second capacitor connected between said second and third I/O ports.

9. A non-reciprocal circuit element according to claim 8, further comprising a terminating resistor connected to any one of the I/O ports.

10. A non-reciprocal circuit element according to claim 9, wherein said second I/O port is grounded and said terminating resistor is connected between said first and third I/O ports.

11. A non-reciprocal circuit element comprising:

a central electrode assembly composed of first and second central electrodes which are disposed on a ferrite member in such a manner that they intersect with each other while being electrically insulated from each other, said first and second central electrodes each having respective first and second ends;

first and second I/O ports which are respectively connected to corresponding first ends of the first and second central electrodes, and a third I/O port which is connected in common to both of the second ends of the first and second central electrodes; and a magnetic circuit for applying a DC magnetic field to said ferrite member;

wherein one of the first and second I/O ports is grounded, and a resistance which is approximately equal to a terminal impedance of said ports is connected in parallel between the other of said first and second I/O ports and the third I/O port.

12. A non-reciprocal circuit element according to claim 11, further comprising a matching circuit which comprises at least one capacitor connected between one of said first and second I/O ports and said third I/O port.

13. A non-reciprocal circuit element according to claim 12, wherein said at least one capacitor is connected between said first and third I/O ports, and further comprising a second capacitor connected between said second and third I/O ports.

14. A non-reciprocal circuit element according to claim 13, wherein said resistance is connected between said first and third I/O ports.

* * * * *